United States Patent [19]

Bogdan et al.

[11] Patent Number: 4,657,584

[45] Date of Patent: Apr. 14, 1987

[54] EFFECT OF MGO SOURCE ON SINTER PROPERTIES

[75] Inventors: Eugene A. Bogdan, North Huntingdon Township, Westmoreland County; Eugene N. Silverman, Churchill Borough, both of Pa.

[73] Assignee: United States Steel Corporation, Pittsburgh, Pa.

[21] Appl. No.: 703,586

[22] Filed: Feb. 20, 1985

[51] Int. Cl.[4] ..... C22B 1/16

[52] U.S. Cl. ..... 75/5; 75/256

[58] Field of Search ..... 75/5, 30, 256

[56] References Cited

U.S. PATENT DOCUMENTS 4,326,887 4/1982 McAllister et al. .

FOREIGN PATENT DOCUMENTS 659855 3/1963 Canada ..... 75/5

035076 1/1973 Japan ..... 75/5

OTHER PUBLICATIONS

Technical paper entitled, "Effects of Replacement of Limestone by Dolomite and Other MgO-Bearing Materials on Production Rate of Iron Ore Sinter", by S. C. Panigrahy, M. Rigaud, and J. Dilewijns, published in *Ironmaking and Steelmaking*, 1984, vol. 11, No. 5-pp. 246-252.

*Primary Examiner*—Melvyn J. Andrews

*Attorney, Agent, or Firm*—William F. Riesmeyer, III

[57] ABSTRACT

A process is provided for sintering iron-bearing particulate materials in which the final sinter contains 3/5.5% MgO, yet has substantially the same strength as a low MgO limestone sinter. At least 20% of the MgO in the final sinter product must come from free MgO-bearing material other than dolomite having a particle size smaller than ⅜ inch, but not more than 20% of it can have a particle size smaller than 1/64 inch. Also, not more than 25% of the MgO in the final product may come from dolomite. The invention includes the relatively higher strength MgO-containing sinter produced.

6 Claims, No Drawings

EFFECT OF MGO SOURCE ON SINTER PROPERTIES

BACKGROUND OF THE INVENTION

The present invention relates to blast furnace sinter of higher than normal MgO content, and particularly to production of high MgO sinter having substantially the same strength as low MgO sinter.

Iron-bearing particulates which would otherwise be too fine for use as a charge material for the iron blast furnace can be made suitable for such use by the process of sintering. Sintering involves heating a mixture of the iron-bearing particulates and various other materials to an elevated temperature at the point of incipient fusion of the iron, causing agglomeration of the material into coarse lump form. The primary constituent of the mixture is usually iron ore although other iron-bearing materials can be used. The latter include ironmaking and steelmaking revert materials such as flue dust, mill scale, sinter returns, and various other recovered wastes containing iron. Fuel is usually added to the sinter mix in the form of coke breeze or other carbonaceous material. Finally, the mixture usually includes a slag former constituent to provide, at minimum, certain slag-forming compounds which are required to obtain strong bonding of the particulates and enhance the strength of the sinter produced. In this respect, sintering can be distinguished from the related process of pelletizing to which the present invention is not applicable by the presence of higher amounts of slag-forming compounds in the sinter mix and the more rapid rate of heating and shorter time at elevated temperature than are used in the mix and treatment for induration of pellets. The sinter mix generally must include at least 16% by weight, and usually more than 20%, of the sum of $CaO+MgO+SiO_2+Al_2O_3$, wherein for pelletizing the total level of these compounds is less than 10 percent.

It is also known to add some of the basic slag-forming materials needed in the blast furnace to the sinter mix so as to provide this material in the sinter itself. Limestone is commonly added in various amounts for this purpose. Dolomite also may be added to provide some of the MgO required in the blast furnace slag. However, it is well-recognized that dolomite additions tend to decrease both the production rate of the sintering process and the strength of the sinter produced. Generally, the decrease in sinter strength has been attributed to the formation of magnesium ferrite, a bonding agent comprised of FeO and MgO, which is more refractory than calcium ferrite. Attempts to compensate for the higher melting point of magnesium ferrite by adding increased fuel to the sinter mix have not proved successful in that the strength of sinter produced was not increased. It was also thought by some that the lower strength was due to dolomite being less reactive than limestone because of its larger crystal size (on a microscopic level) than that of limestone. On this basis, it was proposed that certain dolomites which have a relatively smaller crystal size than others should provide higher strength. However, the use of smaller crystal size dolomite has not provided sinter with strength levels approaching that of limestone sinters.

It is therefore a primary object of this invention to provide a process for producing a sinter having higher than normal MgO content with substantially the same strength level as low MgO sinter.

SUMMARY OF THE INVENTION

The invention is of an improvement in the process for producing blast furnace sinter. The sinter produced may be useful in other iron reduction processes as well, but is primarily intended for use as a charge material in the iron blast furnace. Throughout the specification and claims, all percentages are percent by weight unless otherwise identified. According to conventional procedure, an iron-bearing constituent and a slag former are combined and sintered to provide a final sinter product having Fe within the range 45/60%, the sum of $CaO+MgO+SiO_2+Al_2O_3$ within the range of 16 to 35%, and the balance being essentially oxygen. The improvement of this invention for producing a high-strength sinter product includes said final sinter product having MgO within the range 3.0 to 5.5% and wherein (a) at least 20% of the MgO is provided by utilizing a free MgO-bearing material other than dolomite, said free MgO-bearing material having a particle size less than $\frac{3}{8}$ inch, but not more than 20% being smaller than 1/64 inch, and (b) not more than 25% of the MgO in the final product is provided by dolomite.

In another aspect the invention includes a sinter product consisting essentially of 45/60% iron, 3/15% CaO, 3.0/5.5% MgO, 2.5/9.0% $SiO_2$, 0.25/3.0% $Al_2O_3$, the balance being oxygen, amd wherein the sum of the $CaO+MgO+SiO_2+Al_2O_3$ is within the range of 16 to 35%, the improvement in which said product has a significantly enhanced strength level as indicated by at least 70% of the particulate material subjected to a minitumble test having a size greater than $\frac{1}{4}$ inch after testing.

DESCRIPTION OF THE PREFERRED EMBODIMENT

According to conventional practice, a mixture of an iron-bearing constituent and a slag former is prepared for sintering. The iron-bearing constituent may be selected from the group consisting of iron ore, ironmaking revert materials, steelmaking revert materials, and mixtures thereof. The revert materials may be mill scale, flue dust, sinter returns, and other recovered wastes containing various amounts of iron. Preferably, at least 60%, more preferably at least 80%, of the iron-bearing constituent is iron ore having an iron content of 50/70 percent. The revert materials usually contain 20/70% iron. The iron-bearing constituent must provide iron within the range of 45 to 60% in the final sinter product.

The slag former may be selected from the group consisting of limestone, burned lime, dolomite, burned dolomite, olivines, ironmaking and steelmaking slags, free MgO-bearing materials such as periclase, silica-bearing materials, alumina-bearing materials and mixtures thereof. The slag former is selected so that the sum of $CaO+MgO+SiO_2+Al_2O_3$ in the final sinter product is within the range of 16 to 35%, preferably 20 to 35 percent.

A fuel constituent is usually included in the mixture prior to sintering. The fuel constituent may be selected from various carbonaceous materials such as coal or coke breeze. Sufficient fuel is usually provided to obtain 3.0 to 5.5% carbon in the mixture.

According to this invention, sufficient free MgO-bearing, other than dolomite, is utilized in the mixture to provide at least 20% of the MgO in the final sinter product, the MgO in said final product being within the range of 3.0 to 5.5 percent. The free MgO-bearing material must have a particle size less than $\frac{3}{8}$ inch, but not more than 20% of it can have a particle size smaller than 1/64 inches. Preferably, not more than 20% of the free MgO-bearing material other than dolomite has a particle size smaller than $\frac{1}{8}$ inches. Not more than 25% of the MgO in the final product can be provided by dolomite without a significant decrease in strength. For purposes herein, free MgO-bearing material is defined as that containing at least 80% free MgO, i.e. where the MgO is in an uncombined, free state. Materials such as olivine contain MgO in a combined state as a compound with other components and are not considered free MgO-bearing materials for purposes of this invention. Generally, the MgO contained in steelmaking slags is in a combined state also. Preferably, periclase is utilized as the free MgO-bearing material. Crushed periclase brick is especially suitable for use in the invention.

Returning again to conventional procedure the constituents are mixed together with sufficient moisture to cause the particles to adhere to one another. Various conventional mixing devices may be used, including a rotary drum, pug mill or disc mixer. The mixing operation causes the adhered particles to form micro pellets of suitable size for use in a bed or layer of the material to be sintered. The sintering step may be carried out in any conventional sintering apparatus, although the travelling grate type of machine is most commonly used. Sintering is usually initiated by igniting the fuel in the mixture and causing progressive burning of the material by drawing air through the bed. This causes sufficient heat to be generated for incipient fusion of the iron, resulting in agglomeration of the particles into coarse lump form.

The invention will be illustrated by the following tests carried out using a laboratory minibatch procedure. This procedure has been found to produce sinter of similar characteristics to that made in commercial operations. The strength of the sinter produced was determined by placing a 3-pound composite sample in a cylindrical drum having an inside diameter of 36 inches and a axial length of 5 inches. After the drum has been rotated for 100 revolutions at 24 rpm, the sinter is removed and screened to determine the percent by weight having a size greater than $\frac{1}{4}$ inch. The minitumble test just described has been found to provide a measure of strength accurately corresponding to the values obtained by the International Orgainization for Standardization (ISO) standard tumbler test. The composition of the materials used in the tests is shown in Table I below:

TABLE I

| Material | Weight Percent | | | | |
|---|---|---|---|---|---|
| | Total Iron | CaO | MgO | $SiO_2$ | $Al_2O_3$ |
| Specular Hematite Concentrate | 67.3 | 0.08 | 0.10 | 3.12 | 0.26 |
| BOP Slag | 18.6 | 42.1 | 6.03 | 12.85 | 1.48 |
| Limestone | 0.46 | 51.35 | 2.54 | 3.09 | 0.79 |
| Dolomite | 0.55 | 30.40 | 21.50 | 1.20 | 0.30 |
| Crushed Periclase Brick | 1 | 1 | 93 | 3 | 1 |
| Gravel | — | 0.80 | 0.015 | 97.0 | 0.44 |
| Coke | 3.03 | 1.44 | 0.66 | 6.32 | 2.64 |

The effect of various levels of MgO on the sinter properties when raw dolomite is used is show in Table II. The iron-bearing constituent for these tests was 100% specular hematite concentrate and the resulting final sinter product had an $SiO_2$ of 4 percent. Various proportions of limestone and dolomite were used to vary the MgO content. Also, two levels of base-to-acid ratio were tested to establish the interaction of basicity and MgO content on sinter strength. The results show that increasing MgO content substantially decreases sinter strength when dolomite is the MgO source. This effect is more pronounced at the higher (2.0) base-to-acid ratio level.

TABLE II

| Test | Raw Flux Proportions % Limestone | Raw Flux Proportions % Dolomite | Raw Flux Load Lb./Ton Sinter | Sinter % MgO | Mix % C | Minitumble Strength Index % + $\frac{1}{4}$ Inch |
|---|---|---|---|---|---|---|
| | | | 1.0 Base-to-Acid Ratio | | | |
| 1 | 100 | 0 | 215 | 0.17 | 4.5 | 60 |
| 2 | 50 | 50 | 214 | 1.4 | 4.5 | 60 |
| 3 | 0 | 100 | 217 | 2.7 | 5 | 55 |
| | | | 2.0 Base-to-Acid Ratio | | | |
| 4 | 100 | 0 | 470 | 0.29 | 4 | 76 |
| 5 | 50 | 50 | 455 | 2.7 | 5 | 63 |
| 6 | 0 | 100 | 481 | 5.2 | 5.5 | 62 |

Table III shows the effect of free MgO-bearing materials on sinter strength at the 2.0 basicity level. Again, the iron-bearing constituent was 100% specular hematite concentrate. The % $SiO_2$ content was raised to approximately 7% when BOP slag was used in the mixture. Crushed gravel was added to the mixture where necessary in order to maintain a constant $SiO_2$ level on the other tests in Table III. The results show that the sinter has good strength (greater than 70%) when the particle size of the free MgO-bearing material is within a critical size range. In Test No. 7 the free MgO-bearing material had a particle size smaller than 200 mesh and a sinter strength index of only 64. However, Tests Nos. 8, 9 and 10 had good strength even at the 4.5% MgO level. The free MgO-bearing material utilized in these tests had particle sizes within three separate size ranges, $\frac{3}{8}\times\frac{1}{4}$ inc, $\frac{1}{4}\times 3/32$ inch (8 mesh) and 80% within a range of 3/32 inch (8 mesh)$\times$1/64 inch (40 mesh). Particles larger than $\frac{3}{8}$ inch will not mix properly, preventing a homogeneous mixture from being obtained. Too small a particle size decreases sinter strength. Therefore, these tests show that the free MgO-bearing material should have a particle size smaller than $\frac{3}{8}$ inch, but not more than 20% of it should have a size smaller than 1/64 inch. Preferably, not more than 20% should have a size smaller than 3/32 inch. Finally, the use of dolomite in amounts which provide more than 25% of the MgO significantly decrease sinter strength as shown by Tests Nos. 11 and 12 at the 5% MgO level and Test No. 13 at a lower MgO level.

TABLE III

| Test Number | Raw Flux Proportions % Limestone | % Dolomite | Free MgO-bearing Material % of Total Flux | MgO % By Source Dolomite | BOP Slag | Free MgO Material | % MgO in Sinter | Optimum Mix % C | Minitumble Strength Index % + ¼ Inch |
|---|---|---|---|---|---|---|---|---|---|
| 7 | 100 | 0 | 15% (Reagent Grade MgO) −200 Mesh | 0 | 0 | 100 | 4.4 | 5.0 | 64 |
| 8 | 100 | 0 | 17% (Crushed Periclase) 80% 8 Mesh × 40 Mesh 20% < 40 Mesh | 0 | 0 | 100 | 4.4 | 4.0 | 71 |
| 9 | 100 | 0 | 17% (Crushed Periclase) ¼ Inch × 8 Mesh | 0 | 0 | 100 | 4.5 | 3.5 | 73 |
| 10 | 100 | 0 | 17% (Crushed Periclase) ⅜ × ¼ Inch | 0 | 0 | 100 | 4.5 | 4.0 | 70 |
| 11 | 61 | 39 | 8% (Crushed Periclase) −¼ × 8 Mesh | 50 | 0 | 50 | 4.4 | 4.0 | 65 |
| 12 | 0 | 100 | 0 | 73 | 27 | 0 | 4.1 | 5.5* | 60 |
| 13 | 60 | 40 | 0 | 28 | 72 | 0 | 2.4 | 3.5* | 69 |

*Not Optimum

We claim:

1. In a process for the production of blast furnace sinter, said process including providing a mixture of particulated materials consisting essentially of an iron-bearing constituent and a slag former in sufficient amounts to provide a final sinter product having Fe within the range of 45/60%, the sum of $CaO+MgO+SiO_2+Al_2O_3$ within the range of 16 to 35% and the balance being essentially oxygen, and heating said particulated mixture to an elevated temperature at the point of incipient fusion of the iron so as to cause agglomeration and sintering of the materials in said particulate mixture into coarse lump form;

the improvement in said process for producing a high-strength sinter product which comprises:

providing in said mixture of particulate materials as a portion of said slage former sufficient MgO-bearing material to provide a final sinter product which contains 3.0 to 5.5% MgO, and wherein (a) at least 20% of the MgO is provided by utilizing in said mixture to be sintered a free MgO-bearing material other than dolomite, said free MgO-bearing material having a particulate size less than ⅜ inch but not more than 20% being smaller than 1/64 inch, and (b) not more than 25% of the MgO in the final sinter product is provided by dolomite.

2. The process of claim 1 wherein (a) at least 50% of the MgO is provided by utilizing free MGO-bearing material having particle sizes within said range.

3. The process of claim 1 wherein in the $(CaO+MgO)$ $(SiO_2+Al_2O3)$ is within the range 1.8 to 2.5.

4. The process of claim 1 wherein in (a) not more than 20% of said free MgO-bearing material has a particle size smaller than 3/32 inch.

5. The process of claim 3 wherein at least 60% of the iron-bearing constituent is iron ore containing 50/70% Fe, said final sinter product contains 3.5 to 5.0% MgO and said free MgO-bearing material is periclase.

6. The process of claim 3 wherein at least 80% of the iron-bearing constituent is iron ore containing 50/70% Fe, said final sinter product contains 3.5 to 4.5% MgO, and wherein said free MgO-bearing material is periclase.

* * * * *